United States Patent [19]

Ovitz, III

[11] Patent Number: 4,685,573

[45] Date of Patent: Aug. 11, 1987

[54] SAMPLE DISPLAY STAND

[75] Inventor: Ernest G. Ovitz, III, Galva, Ill.

[73] Assignee: John H. Best & Sons, Inc., Galva, Ill.

[21] Appl. No.: 838,164

[22] Filed: Mar. 10, 1986

[51] Int. Cl.[4] ..... A47F 7/16

[52] U.S. Cl. ..... 211/46; 211/162

[58] Field of Search ..... 211/46, 94, 162, 122; 160/340, 341, 344, 196 R, 196 D; 16/96 R, 94 R, 87 R, 95 R; 104/106, 107, 109, 110

[56] References Cited

U.S. PATENT DOCUMENTS

| | | | |
|---|---|---|---|
| 564,004 | 1/1896 | Coburn | 104/109 |
| 658,041 | 9/1900 | Main | 211/46 |
| 660,999 | 10/1900 | Richard | 104/109 |
| 2,851,167 | 9/1958 | Rosenberg | 211/162 X |
| 3,043,408 | 7/1962 | Attwood | 104/107 X |
| 4,238,550 | 12/1980 | Burgess et al. | 211/162 X |

FOREIGN PATENT DOCUMENTS

| | | | |
|---|---|---|---|
| 755944 | 4/1967 | Canada | 211/46 |

*Primary Examiner*—Ramon S. Britts
*Assistant Examiner*—Sarah A. Lechok Eley
*Attorney, Agent, or Firm*—Kinzer, Plyer, Dorn & McEachran

[57] ABSTRACT

A rug display stand has a track structure for sliding panels of such construction that heavy rugs may be suspended without distorting the tracks, avoiding the need to anchor tracks in the ceiling; hence, the stand is portable.

4 Claims, 5 Drawing Figures.

Fig. 1.
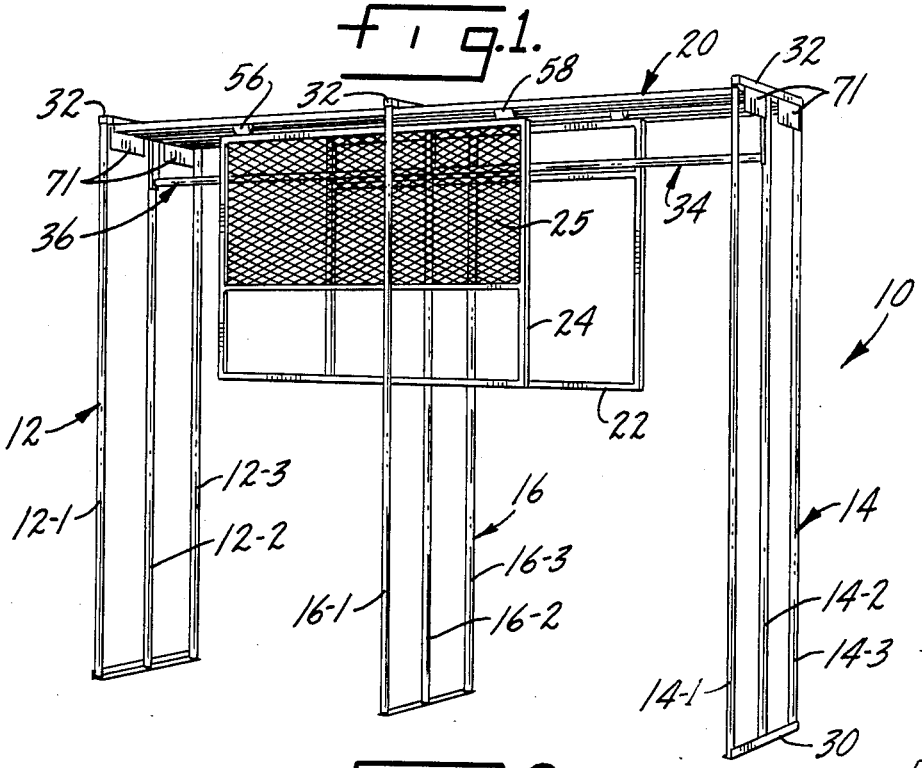
Fig. 2.
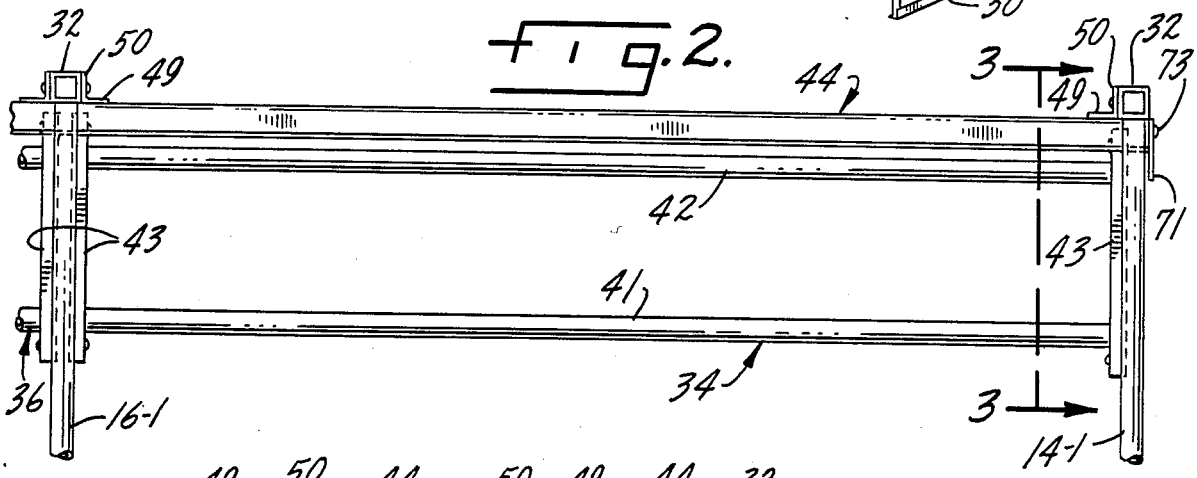
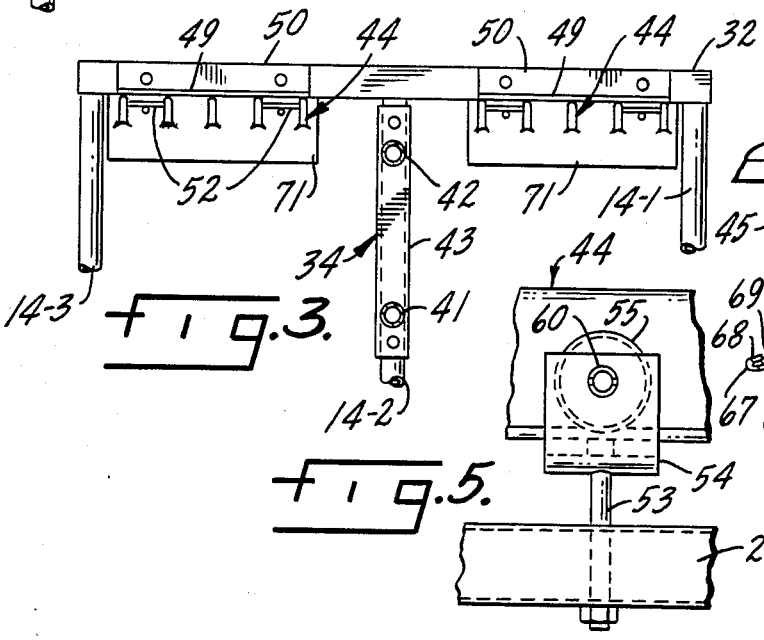
Fig. 3.
Fig. 4.
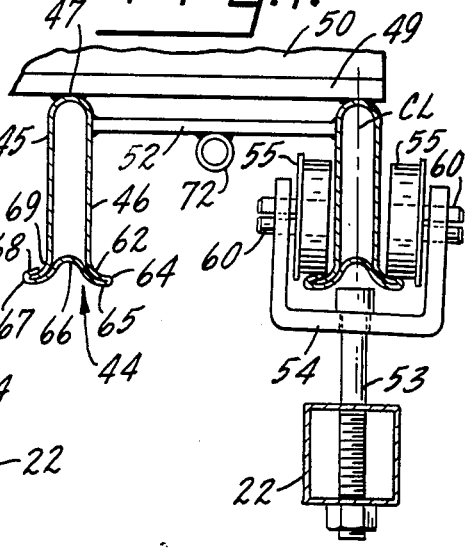
Fig. 5.

SAMPLE DISPLAY STAND

BACKGROUND

Sliding panel rug display stands are known but in the instance of large rug samples of considerable weight, tracks for the sliding panels need to be secured to ceiling joists or beams. This limits the location of the sample display stand and clearly the display is not portable.

OBJECTIVES OF THE PRESENT INVENTION

The present invention addresses the problem of suitably supporting sliding display panels for heavy samples (rugs or the like). A track structure of unusual form is devised which will not bend under the weight of the rugs and hence need not be anchored to overhead joints or beams. At the same time, the tracks may be supported on a portable, floor-mounted frame which can be set in any convenient place and relocated when desired, which is especially advantageous where the floor plan is rectangular. The present structure is also a space-saver compared to certain traditional rug sample display stands characterized by triangular swinging panels, which can sometimes be awkward to locate because of the swinging arc and which are limited to the weight they can bear because of cantilevering.

Specifically, the objectives are achieved and the problems solved by so structuring the track that the bending moments induced by rollers gliding thereon are opposed.

BRIEF DESCRIPTION OF THE DRAWING

FIG. 1 is a perspective view of one form of display stand constructed in accordance with the present invention;

FIG. 2 is a fragmentary front elevation at the top of the stand;

FIG. 3 is a sectional view on the line 3—3 of FIG. 2;

FIG. 4 is an enlarged detail end view of the track and roller conbination;

FIG. 5 is a fragmentary elevation of the track and roller combination.

DETAILED DESCRIPTION

The rug display stand 10 shown in FIG. 1 includes a main frame characterized by a pair of upright end post structures 12 and 14 and a medially located post structure 16.

This framework supports at the top a plurality of tracks collectively identified in FIG. 1 by reference character 20. For each track there is a sliding panel. The sliding panels may vary as to geometrical configuration and functional purpose. There may, for example, be a plain rectangular panel 22 for supporting a large rug sample and a second rectangular panel 24 having a mesh section 25 enabling small rug samples to be suspended anywhere thereon. These panels are only representative, as mentioned, and many variations are possible. The rug samples may be full size and may extend from the very top of the frame to floor level.

The end posts 12 and 14 and the medial post 16 are virtually identical in construction. There are three upright bars such as 14-1, 14-2 and 14-3, shown in FIG. 1. The lower ends thereof are secured in any suitable fashion to an angle bar 30. At the top, the upright bars are braced by cross tubes or headers 32 to which they may be welded.

The frame is further rigidified by body braces 34 and 36. These body braces are identical and brace 34 is shown in detail in FIG. 2. It comprises a pair of elongated rods 41 and 42 having their ends welded or otherwise secured to channel members 43 which in turn are secured by screws to the medial ones of the uprights 12-2, 14-2 and 16-2.

The track structure indicated generally by the reference character 20 in FIG. 1, at the top of the frame, is shown in the present embodiment, FIG. 3, as comprising ten separate track members 44, each of identical construction. In FIG. 3, the tracks are shown somewhat diagrammatically but in FIG. 4 details are shown. A description of one track structure suffices to explain the remainder.

The track members 44 extend continuously from one end of the frame structure to the other so that the panels as 22 and 24 may glide independently from one end of the structure to the other, without interference.

Each track member 44 is preferably of one-piece rolled steel and, as shown in FIG. 4, is an inverted troughshaped member having a pair of opposed sides 45 and 46 joined at the top by an integral arch 47. The arch 47 is welded or otherwise secured to the horizontal leg 49 of an angle bar 50 which in turn is welded or otherwise fastened to the header 32, one at each end of the frame structure. Also, as shown in FIG. 3, there are a pair of such angle bars 50 secured to each cross member or header 32. In other words, there are five track members 44 hanging from the bottom of each angle 50 and as shown in FIG. 4, the outside track pairs are preferably held in spaced relationship by a cross strut 52, the ends of the latter being welded or otherwise fastened to opposed sides of opposed track members.

As mentioned above, the weight of the rug samples can be considerable and in accordance with the present invention the track structure is such that the weight may be easily borne without distorting the tracks. In this connection it may be pointed out that the top horizontal cross member of a rug display panel as 22, FIGS. 4 and 5, is suspended by a bolt 53 having its shank passed through an opening in a roller shackle 54. The roller shackle 54 journals a pair of rollers 55. As shown in FIG. 1, each panel is suspended by two roller-shackle assemblies 56 and 58. Each shackle-roller assembly 56 and 58, FIG. 1, is identical to the structure shown in FIGS. 4 and 5, as to which the description will now be continued.

The track rollers 55 are of any preferred, low-friction sturdy material and they rotate on pins 60 supported in the upright legs of the shackles 54, or are journaled for free rotation in any other preferred manner.

As mentioned above, each track member 44 is preferably of rolled steel, an extrusion which is trough-shaped in section, and presenting a pair of opposed sides 45 and 46. One of the side members (46 in this instance) terminates at the bottom in an extension 62 (of considerable length as will be seen). Thus, the extension 62 is bent into a rather complicated geometric pattern for the purposes of this invention. The extension 62, at the bottom of the side member 46, includes an outwardly extending lateral portion 64 which is bent back upon itself at 65 to afford a first outwardly extending lateral track for one of the rollers 55 as will be evident in FIG. 4.

The extension 62 inward from the lateral track is extended upwardly into the space between the trough sides 45 and 46 as a medial portion 66. The medial portion is arch shaped and is symmetrical on opposite sides of the center line CL of the trough. From the medial portion 66 which lies between the trough sides 45 and 46, the portion 62 of the track member is then extended outwardly at 67 to afford a second lateral track for the other glide or roller 55 as will be evident in FIG. 4. Finally, the portion 67 is bent inward at 68 toward the arch 66 and is mated to an outwardly bent extension flange 69 at the bottom of the trough side 45, completing the second of the two tracks. The tracks lie substantially in a horizontal plane and are spaced substantially equally on opposite sides of the trough center line CL.

Panel stop plates 71, FIG. 1, are located at the ends of the stand. To secure these in place, the cross braces or spacers 52, FIG. 4, are provided with stubs 72 for fasteners 73, FIG. 2, by which the stop plates are firmly anchored.

It can be visualized from what is shown in FIG. 4 that the weight of the suspended rug, transmitted to the two lateral tracks by the rollers 55 engaged therewith, produces moment arms measured from the longitudinal center line of the trough. However, these moment arms in turn are opposed by the medial portion 66, in compression. Thus, by virtue of this geometry, a considerable weight may be imposed on the two lateral tracks without distorting them, at least from the standpoint of rug samples that can be displayed on the present stand. Such rug samples may be actual six-by-nine (6′×9′) size, not mere samples themselves. To further visualize this, the display stand shown in FIG. 1 is 9 feet 10 inches high and has a length, end-to-end, of 12 feet.

Hence, while a preferred embodiment of the invention has been illustrated and described, it is to be understood that this is capable of variation and modification.

I claim:

1. In a display stand for rug samples and the like, having an upright floor-mounted frame supporting, at the top, a plurality of horizontal tracks enabling panels which support such samples to be suspended therefrom for sliding movement back and forth by which the customer may examine the samples, an improved track and suspension means combined with each such panel and comprising:

an elongated track member of steel plate of general inverted hollow trough shape having spaced opposed sides joined at the top, one side of said track member having a long extension at the bottom thereof including a portion which extends laterally to one side of said trough to afford a first lateral track for one roller, which extension is folded back upon itself and thence upward as a medial portion into the space between the trough sides at the bottom thereof, and which extension then extends from said medial portion laterally outward to the other side of said trough to afford a second lateral track for a second roller;

the opposite side of said track member at the bottom thereof including a lateral extension mated to said second lateral track, the two lateral tracks being substantially in the same plane whereby a weight suspended thereon results in opposed moment arms opposed by said medial extension portion; a roller shackle suspending a sample display frame; and said shackle supporting a pair of rollers respectively engaging said tracks.

2. Display stand according to claim 1 in which the panels are suspended from a roller shackle, and said roller shackle presenting journals for the rollers.

3. Display stand according to claim 1, in which the tops of the track members are welded to an angle bar in turn supported at the top of the frame.

4. Display stand according to claim 1 in which the lateral tracks extend outwardly substantially equal distances from the vertical center line of the troughs and in which said medial portion of the extension is substantially symmetrical about said center line.

* * * * *